US006107909A

United States Patent [19]

Kosinski

[11] Patent Number: 6,107,909

[45] **Date of Patent: *Aug. 22, 2000**

[54] TRIMMED SURGE RESISTORS

[75] Inventor: John P. Kosinski, Menomonee Falls, Wis.

[73] Assignee: Microlectronic Modules Corporation, New Berlin, Wis.

[ * ] Notice: This patent is subject to a terminal disclaimer.

[21] Appl. No.: 09/255,484

[22] Filed: Feb. 23, 1999

Related U.S. Application Data

[63] Continuation-in-part of application No. 08/917,972, Aug. 27, 1997, Pat. No. 5,874,887.

[51] Int. Cl.[7] ..... H01C 10/48

[52] U.S. Cl. ..... 338/195; 338/20; 338/22 R; 29/610.1

[58] Field of Search ..... 338/195, 20, 21, 338/22 R; 29/610.1

[56] References Cited

U.S. PATENT DOCUMENTS

| | | | |
|---|---|---|---|
| 3,846,731 | 11/1974 | Dumas et al. . | |
| 4,146,673 | 3/1979 | Headley | 428/335 |
| 4,475,099 | 10/1984 | Praria . | |
| 4,859,981 | 8/1989 | Peschl . | |
| 4,929,923 | 5/1990 | Dharmadhikari . | |
| 4,999,731 | 3/1991 | Bender et al. . | |
| 5,043,694 | 8/1991 | Higashi et al. | 338/195 |
| 5,184,108 | 2/1993 | Bloom et al. . | |
| 5,198,794 | 3/1993 | Sato et al. . | |
| 5,363,084 | 11/1994 | Swinehart . | |
| 5,428,339 | 6/1995 | Das . | |
| 5,436,609 | 7/1995 | Chan et al. . | |
| 5,493,148 | 2/1996 | Ohata et al. . | |
| 5,504,470 | 4/1996 | Ginn . | |
| 5,874,887 | 2/1999 | Kosinski | 338/195 |

OTHER PUBLICATIONS

Hybrid Circuit Technology "Laser Technology, Dispensing Equipment " Jul. 1987, authors Alan and Cable Ann Rogers, Electro Scientific Industries, Inc., Portland Ore.

*Primary Examiner*—Michael L. Gellner
*Assistant Examiner*—Richard K. Lee
*Attorney, Agent, or Firm*—Reinhart, Boerner, Van Deuren, Norris & Rieselbach, s.c.

[57] ABSTRACT

An electrical resistor having a resistance value and capable of withstanding high power surges, utilizing a thick film deposited on a substrate and trimmed with one or more cuts configured to maintain a level of current crowding while increasing the resistance value of the resistor. A surge resistor can be modified in a similar fashion.

20 Claims, 5 Drawing Sheets

TRIMMED SURGE RESISTORS

This application is a continuation in part of Ser. No. 08/917,972, filed Aug. 27, 1997 now a U.S. Pat. No. 5,874,887.

BACKGROUND OF THE INVENTION.

This invention relates generally to trimmed surge resistors for electrical circuits and, more specifically, to the modification of such resistors to achieve precision tolerances.

The development of various ceramic and/or cermet materials made possible many of the recent developments in resistor technology. Such materials are very stable at high temperatures and capable of withstanding temperature and voltage extremes. It is possible to customize these materials to provide resistance values which range from an ohm or less to megaohm values. Such variations in function may be incorporated into the materials during manufacture and/or during the associated firing and/or curing processes. A particular benefit of these materials is that they can be applied to a variety of circuit substrates using well-known thick film techniques such as screen printing.

Neither the materials nor their application lend themselves to an exacting resistance value. As a practical matter, excess material is applied to, for instance, a substrate, then trimmed or removed from the resistor. Removal techniques have become more sophisticated in recent years and now encompass the latest laser technology. Any trim or cut must be made such that the resulting resistance value is less than or equal to the value desired, as additional trimming can only increase the final value. Regardless of the technique, the material removed must provide the desired resistance value.

Various concepts related to the trimming of excess material are provided by way of the prior art, in particular in U.S. Pat. Nos. 5,043,694 and 5,504,470—both of which are incorporated herein by reference in their entirety. The importance of resistor trimming is amplified in the situation where there can occur large electrical surges across a circuit. Survival of the resistor requires a high quality material and thick film. Compositional deficiencies or defects in the application may lead to failure under high surge conditions.

U.S. Pat. No. 4,528,546 discusses resistors in the context of high surge conditions. Incorporated herein by reference in its entirety, this prior art patent illustrates, schematically, a typical resistor component. Electrical terminals can be formed by screen printing a conductive composition on a ceramic substrate. A ceramic and/or cermet material can then be screen printed on the substrate to connect the terminals.

Typically, the initial resistance value of a resistor will be known, calculated based on the number of ohms per square of resistor, where a square is one unit of equal length and width. Decreasing the effective width of a resistor to one-half the original will double the number of squares and simultaneously double the resulting resistance value. Trimming can be conducted with intermittent resistance measurements. However, for precise resistors, resistance is monitored while the trimming proceeds. For instance, when a desired resistance level is reached, the laser trimming device can be disengaged to prevent further removal of resistor material.

U.S. Pat. No. 4,528,546, as referenced above, illustrates a simple plunge cut into the resistor. This method of trimming is quite simple and serves sufficiently to increase resistance value. However, a large voltage gradient, resulting from the redirection of current, will invariably exist across the cut. In addition, it has been shown that the current crowds into a region surrounding the terminus of the cut opposite the end point on the resistor edge. In addition, during a surge condition, the voltage gradient may cause arcing across the cut/trim, arcing of the sort which could also destroy the resistor.

Plunge cuts can be used alone or in combination with a variety of scan cuts. Scan cuts are made parallel to the current flow and alleviate current crowding conditions. The cut/trim is relatively simple and the increase in resistance directly calculated. When used in combination with one or more plunge cuts, current is prevented from flowing into the resulting trimmed portions.

U.S. Pat. No. 5,504,470 describes combining an initial terminal to terminal scan cut with a plurality of plunge cuts, otherwise referred to as a comb cut. The comb cut is described as preventing arcing due to excessive voltage gradients across each plunge. The cuts and/or trimming is described in conjunction with many different prior art resistor devices and a variety of removal methods, all of which are specifically incorporated by reference herein in their entirety. The cuts are straight and easy to incorporate. Because there are no endpoints in the resistive portion of the film.

U.S. Pat. No. 5,043,694, as referenced above, describes a variety of cuts/trims of the prior art, including various u-shaped, square and semi-circular cuts. This patent departs from the prior art in describing a trimming groove having two curved portions linked by a straight portion parallel to a linear resistor edge. The resulting configuration resembles the outline of a paper clip placed along the edge of a resistor, with the curved portions directed toward the electrodes. Various cut/trim configurations are also described inside the outline to further precisely trim or adjust resistance values.

Nonetheless, the prior art has associated with it various problems and deficiencies. With reference to the resistor described in the '470 patent, exacting precision is required in the trimming to eliminate any film on either end of the scan cut or between the plunge and scan cuts, to prevent extreme current crowding and certain circuit failure. This situation is avoided with the resistor described in the '694 patent: curved cuts avoid the residual film problem. However, trimming in this manner is relatively time-consuming. Regardless, with either a scan cut or a curved cut, resistance is, in large part, controlled by the initial cut. Further trimming to increase resistance precisely to a desired value is difficult. There is a need for a trimmed surge resistor and method for its preparation, to provide benefits not otherwise possible.

BRIEF DESCRIPTION OF THE DRAWINGS

FIG. 1B shows schematically the current path induced by such a U-cut of the prior art.

FIG. 2A shows a U-cut with a coupled J-cut and/or J-shaped groove; FIG. 2B shows a U-cut with a J-cut/J-shaped groove coupled to each leg thereof; and FIG. 2C shows a U-cut with a plurality of J-cuts/J-shaped grooves coupled in succession to one leg thereof. FIG. 2A shows schematically that the current pathway of FIG. 1B is not incrementally or otherwise crowded by additional trimming, also in accordance with this invention.

SUMMARY OF THE INVENTION

Figure 1A:
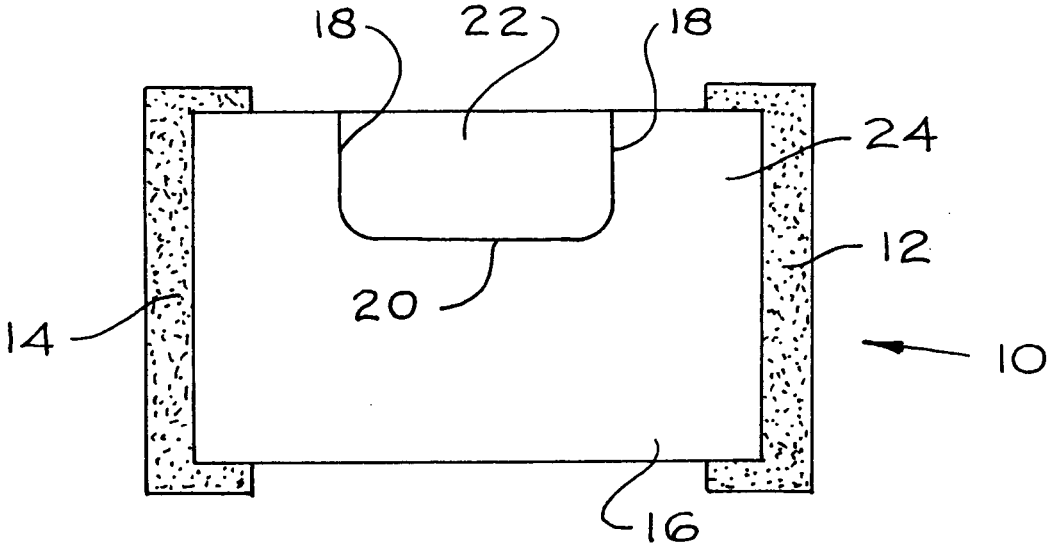
Fig. 1A Prior Art
FIGS. 1A and 1B show, for purposes of comparison, electrical components of the prior art trimmed with a U-cut; in particular.

Accordingly, it is an object of the present invention to provide a resistor component for protection against over voltage and/or surge conditions and methods for the preparation of such a component, overcoming various deficiencies and shortcomings of the prior art, including those outlined above. It will be understood skilled in the art that one or more aspects of this invention can meet certain objectives, while one or more other aspects meet certain other objectives. Each objective may not apply equally, in all instances, to every aspect of the invention. As such, the following objects—in light of the prior art regarding trimmed resistors—can be viewed in the alternative with respect to any one aspect of the present invention.

It is an object of the present invention to provide a method of trimming precisely a surge resistor with tight tolerance limits, and/or without further trimming an initial scan or perimeter cut.

It can also be an object of the present invention to provide a quick, efficient method for trimming a resistor component which permits trimming to a desired resistance value without further trimming of an initial scan or perimeter cut.

It can also be an object of the present invention to provide a trimmed resistor component and/or a method for further trimming which does not increase current crowding, which does not place an endpoint of a cut within the current path, which does not cause micro-cracking of a resistive material, and/or which does not promote a change of resistance value under surge conditions.

It can also be an object of the present invention to provide a trimmed resistor and/or method for further trimming which prevents increased current crowding and arcing between trimmed portions of a resistive material.

It can also be an object of the present invention to provide a method of trimming a resistive material to achieve a desired resistance value which permits resistance to be monitored during the trimming maneuver and the cut trimmed without an endpoint within the current path.

The resistors, components and/or methods of the present invention can suitably comprise, consist of, or consist essentially of various elements and/or components, including those specifically described herein. Each such resistor, component and/or method is distinguishable, characteristically contrast, and can be practiced in conjunction with the present invention separate and apart from another. Accordingly, it should be understood that the inventive compositions and/or methods, as illustratively discussed herein, can be prepared and/or practiced in the absence of any one element, species and/or step which may or may not be specifically disclosed, referenced or inferred herein, the absence of which may or may not be specifically disclosed, referenced or inferred herein.

Other objects, features and advantages of the present invention will be apparent from this summary and the figures and examples thereof, especially so to those skilled in the art having knowledge of the preparation of such resistors and related components. Such objectives, features, benefits and advantages will be apparent from the above as taken in conjunction with the accompanying figures, examples, data and all reasonable inferences to be drawn therefrom.

In part, the present invention is a method of modifying a surge resistor. The method includes (1) providing a thick film high voltage surge resistor with an initial resistance value, the thick film trimmed with a U-cut having endpoints outside the thick film to provide a trimmed film portion on one side of the U-cut and a resistive film portion on the other side of the U-cut; and (2) coupling a J-cut with the U-cut on the resistive film portion, the J-cut having a leg portion along and a distance apart from the leg portion of the U-cut and an endpoint outside the thick film, and a curved portion having a radial dimension like the curved connector portion of the U-cut. Without limitation, such a method can provide a predetermined resistance, with the current crowding remaining substantially unchanged. The leg portion of the J-cut can have a length dimension which varies depending upon the initial resistance value and the modification desired. In preferred embodiments, the leg portion of the J-cut can be substantially parallel to the leg portion of the leg U-cut and/or the curved portion of the J-cut can have radial dimension substantially the same as that of the curved portion of the U-cut. Current crowding remains substantially unchanged where, when using the present invention, the combination of the J-cut leg and curved portions do not extend beyond the connector portion of the U-cut.

Alternatively, in applications where a greater degree of trimming is required to reach the predetermined resistance value, the J-cut leg can be extended beyond the connector portion of the U-cut. In these embodiments, a second curved portion in the J-cut couples the J-cut to the U-cut. Both the first and second curved portions of the J-cut preferably have a radial dimension substantially the same as that of the curved portion of the U-cut to minimize current crowding in the resistor component. Preferably, the first and second curved portions are joined by a generally linear portion which is substantially parallel to the linear base section of the U-cut. To further minimize current crowding in the resistor, the second curved portion preferably extends only a relatively short distance past the linear base section of the U-cut.

Preferred embodiments of the present invention can also include coupling a plurality of J-cuts. After an initial J-cut coupled with a U-cut, another J-cut can be joined to one or both of the coupled J-cut and U-cut. Whether or not an additional J-cut is incorporated, the J-cut can include at least one plunge-cut from the edge of the trimmed portion to the curved portion of the U-cut. In highly preferred embodiments, a plurality of such plunge-cuts are incorporated such that the trimmed portion inside the U-cut includes a comb cut.

In part, the present invention is a method of maintaining a level of current crowding in a trimmed surge resistor, while increasing the resistance value of the resistor. The method includes (1) providing a high voltage surge resistor with an initial resistance value, the resistor trimmed with an initial cut having endpoints outside the resistor to provide a trimmed portion on one side of the initial cut and a resistive portion on the other side of the cut; (2) cutting a groove within the resistive portion and along the cut, the groove having an endpoint outside of the resistor; and (3) extending the groove to the initial cut with a curved cut having a radial dimension. The curvature does not extend the groove into the current pathway of the resistor. Preferred embodiments include those mentioned above, particularly with respect to the initial cut, the groove, the curved cut, and the preferred relationship thereof. The initial cut is preferentially curved, having endpoints outside the resistor. In highly preferred embodiments, the curved initial cut is a U-cut and the groove is the leg portion of a J-cut, which is extended to the U-cut with a curved cut having a radial dimension like that of the curved portion of the U-cut.

In other preferred embodiments, the groove can be cut with a length dimension to meet the modification desired of the initial resistance value. Likewise, in preferred embodiments, a U-cut can include at least one plunge cut from the edge of the trimmed portion to the curved portion of the U-cut. In highly preferred embodiments, there are a plurality of plunge cuts such that there is formed a comb cut in the trimmed film portion defined by the U-cut. Regardless of the presence of one or more plunge cuts, a highly preferred embodiment can include additional parallel groove cutting and extension to the U-cut. Alternatively, such cutting and extension can be made with respect to a previously cut parallel groove.

In part, the present invention is a resistor capable of withstanding high power surges. The resistor includes (1) a resistive thick film on a substrate between a pair of electrodes; (2) a U-shaped groove in the thick film dividing the thick film into a resistive portion and a trimmed portion, with a U-shaped groove having endpoints outside the thick film and a radius of curvature to control current crowding; and (3) at least one J-shaped groove coupled to the U-shaped groove, with the J-shaped groove having an endpoint outside the resistive portion and a radius of curvature like the radius of curvature of the U-shaped groove. Preferred embodiments can include those features described above with respect to the position of the leg portion of such a J-shaped groove and its radius of curvature, as compared to the U-shaped groove.

In preferred embodiments, the U-shaped groove includes at least one plunge cut from the edge of the trimmed portion to the curvature of the U-shaped groove. In highly preferred embodiments, a plurality of such plunge cuts provides a comb cut in conjunction with the U-shaped cut. Likewise, preferred embodiments can also include a plurality of J-shaped grooves, such that at least one of the grooves is coupled to the U-shaped groove. Where at least two U-shaped grooves are present, it is highly preferred that one such groove is coupled to the U-shaped groove.

In part, the present invention is an electrical resistor component having a precise resistance value and capable of withstanding high power surges. The resistor component is of the type in which a thick film is deposited on a substrate and trimmed with a U-cut which divides the thick film into a resistive portion and a trimmed portion; such a resistor component can have an improvement including at least one J-cut which provides a post-trim tolerance of about ±0.05%, with the J-cut coupled to the U-cut and having a leg portion substantially parallel to the leg portion of the U-cut, an endpoint outside the resistive portion, and a curved portion having a radial dimension substantially the same as the curved portion of the U-cut.

In preferred embodiments, the leg portion of the U-cut has a variable length dimension, for precise modification of initial resistance value. Alternatively, the resistor component can include a plurality of J-cuts, at least one of which is coupled to a U-cut. Whether or not there are a plurality of J-cuts, the U-cut can include either a plurality of plunge cuts or a comb cut within the trimmed portion defined by the U-cut.

With reference to the figures, the methods and apparatus of this invention can be understood in the context of a resistor component. As shown in FIG. 1A and those which follow thereafter, component 10 has electrical terminals 12 and 14 with resistor 16 therebetween. It is understood that terminals 12 and 14, together with resistor 16, will typically be formed as thick film materials upon a substrate, although there is no specific requirement thereof Even so and without limitation, material choices for the substrate, terminals, and resistor will be well known to those skilled in the art. Various embodiments can include any alumina substrate with palladium-silver electrodes and a cermet resistive material screen-printed thereon.

Figure 1B:
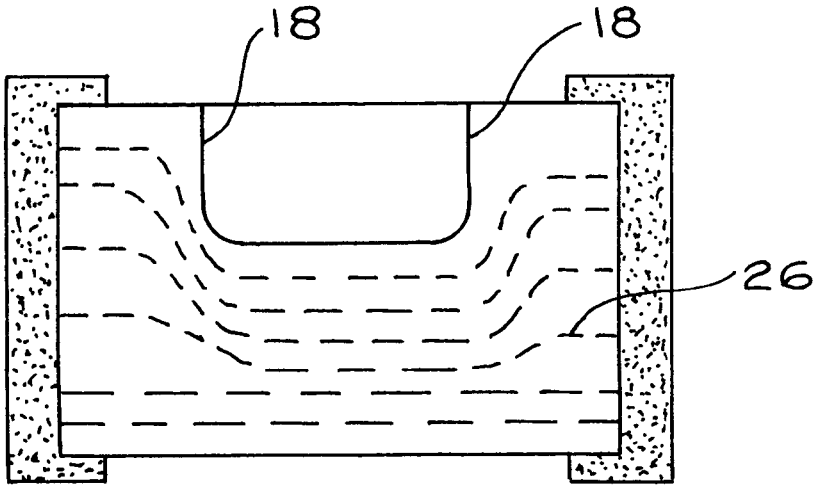
Fig. 1B Prior Art

Preferred embodiments of the present invention can be utilized in conjunction with various trims and cuts of the prior art. For purposes of illustration and with reference to FIG. 1A, resistor 16 can be trimmed with a U-cut having leg portions 18 joined by linear cut 20. The U-cut increases the resistance value of resistor 16 and divides it into trimmed and resistive portions 22 and 24, respectively. Current pathways 26 between terminals 12 and 14 are schematically represented in FIG. 1B and are directed around the periphery of the U-cut, with crowding in the area of the resistive portion in the proximity of the curved portions of the U-cut. As mentioned above, such regions will heat very unevenly and may cause the resistor to destructively fail. As previously mentioned, it is an object of the present invention to provide a method to further increase resistance value without contribution to current crowding. It will be understood by those skilled in the art that the trims/cuts illustrated in the figures are shown by lines which represent the three-dimensional removal of material from the resistor.

Figure 2A:
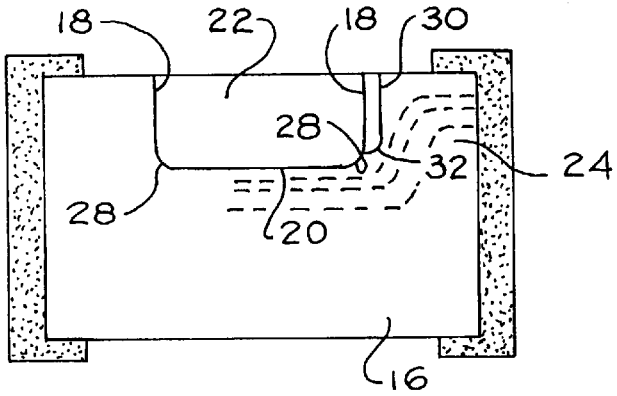
FIGS. 2A–2C are schematic representations of electrical resistors and/or resistor components, in accordance with this invention and as can be prepared therewith.

Referring to FIG. 2A, resistor 24 is trimmed with a U-cut having leg portions 18 joined by linear cut 20 at curved connector portions 28. Additional resistance can be imparted by modifying resistor 24 with cut/groove 30 at a distance apart from leg portion 18. In preferred embodiments, cut/groove 30 is substantially parallel to leg portion 18. Regardless, cut/groove 30 is coupled to leg portion 18 by curved cut/groove 32. Cut/groove 30 can have a variable length dimension depending upon the incremental resistance to be imparted. With reference to current pathways 26, it will be understood, however, that the combination of groove/cut 30 and curved portion 32 does not extend beyond curved connector 28 of the U-cut and/or into the current pathway.

Figure 2B:
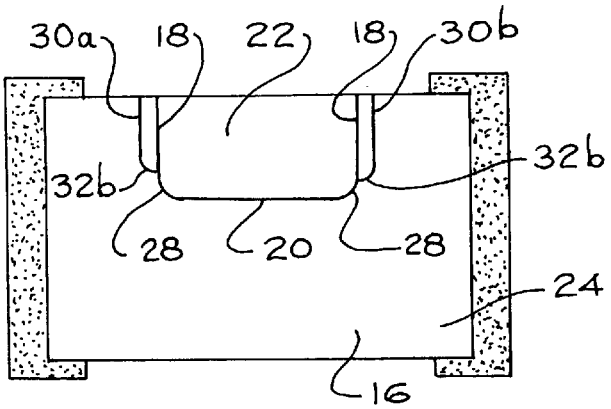

Another embodiment of the present invention is illustrated in FIG. 2B. A plurality of trims are coupled to the U-cut, with such a configuration useful to incrementally increase the resistance value of the resistor beyond that initially imparted by the initial cut. As shown in FIG. 2B, cuts/grooves 30*a* and 30*b* are made a distance apart from the respective leg portions 18 of the U-cut. Again, in preferred embodiments but not necessarily so, cuts/grooves 30*a* and 30*b* are substantially parallel to such leg portions. Regardless, they are coupled and/or joined to leg portions 18 of the U-cut and, in order to prevent further current crowding, do not extend beyond curved connector portions 28.

Figure 2C:
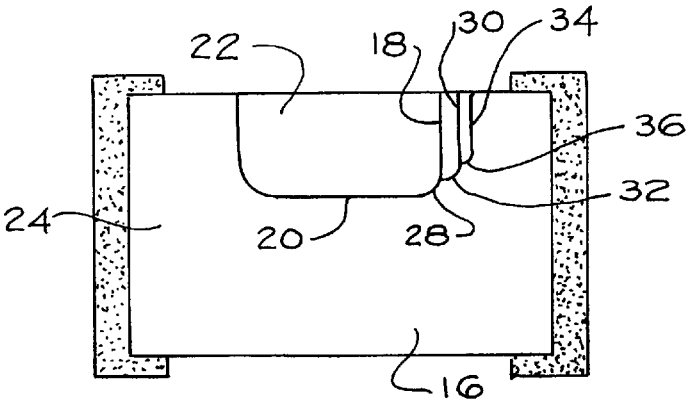

FIG. 2C illustrates another embodiment of this invention. A series of J-shaped cuts/grooves can be used in conjunction with leg portion 18 of an initial cut. In such a way, resistance can be increased by making cut/groove 30 in resistive portion 24 and extending it until such a time when the final resistance value is met by extension thereof with curved portion 32 and coupling with leg portion 18. If an incremental amount of resistance is required another cut/groove 34 can be made and extended to approach the desired resistance value, at which point curved portion 36 is used to couple or join cut/groove 34 with cut/groove 30. The radial dimension or degree of curvature of curved portion 36, curved portion 32 and curved connector 28 are sufficiently alike so as to not extend cuts/grooves 30 and 34 into the current pathway imposed by the initial cut. In preferred embodiments, such radii or degrees of curvature are substantially the same. As discussed in connection with the embodiments of FIGS. 2A and 2B, the grooves/cuts of FIG. 2C are made a distance apart first from leg portion 18, then from cut/groove 30. Preferably, leg portion 18 and cuts/grooves 30 and 34 are substantially parallel one to another, for reasons relating to available trimming technology and calculation/monitoring of the increase of resistance value imparted by each successive trim.

Figure 3A:
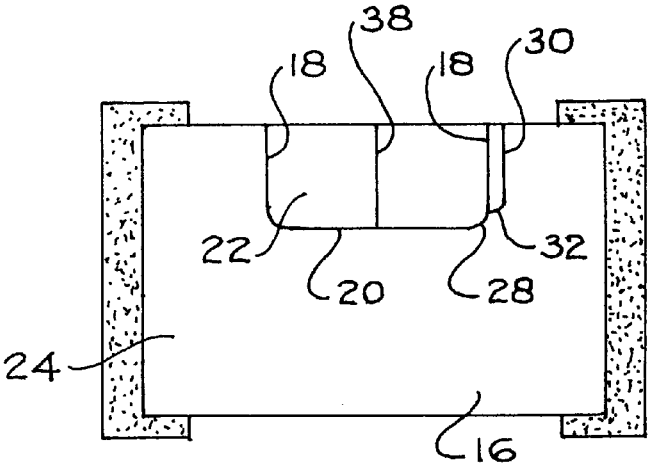
FIGS. 3A–3C are also schematic representations of electrical resistors and/or resistor components similar to those representations of FIGS. 1A–1C but including one (3A) or more (3B and 3C) plunge-type cuts, also in accordance with this invention and as can be prepared therewith.
Figure 3B:
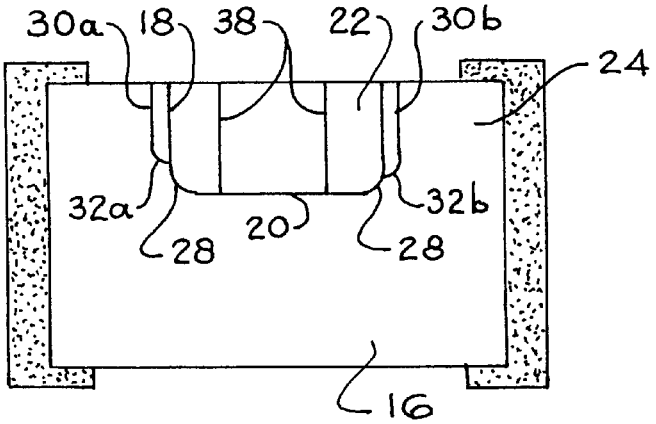
Figure 3C:
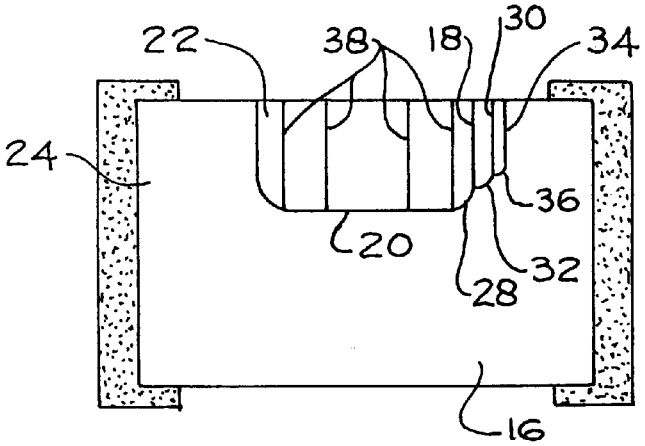
Figure 4:
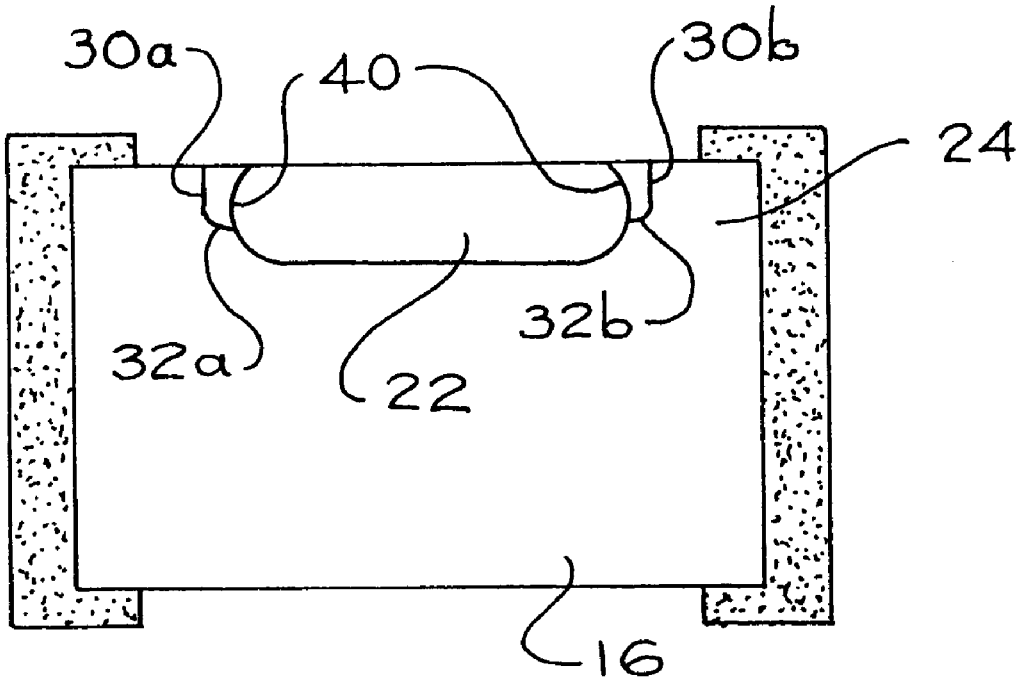
FIG. 4 illustrates another initial cut of one type which can be utilized with the present invention.

FIGS. 3A–3C represent various other embodiments of the present invention and show incorporated therewith one (FIG. 3A) or a plurality of (FIGS. 3B and 3C) of plunge cuts in conjunction with an initial U-cut and the incremental cuts of this invention. As mentioned above, a plurality of such plunge cuts 38 comprise a comb cut or an isolation comb cut, as would be recognized by those skilled in the art. Such cuts can be utilized to minimize arcing and are typically effective to about 300 volts per cut; e.g., 10 cuts can be used if resistance to 3000 volts of lightning surge is desired. Another representative embodiment of the present invention is as shown in FIG. 4. Additional trimming to increase resistance value can be accomplished by one or more J-cuts or J-grooves as shown therein. Curved groove 40 can be initially made as shown in FIGS. 1–5 of incorporated U.S. Pat. No. 5,043,694. As with other embodiments of the present invention, the component illustrated in FIG. 4 can be prepared as otherwise described herein. Grooves/cuts 30*a* and 30*b*, in combination with the respective curved portions 32*a* and 32*b* do not extend into the current pathway otherwise imposed upon resistor 24 by curved cut 40. One or more plunge cuts of the type described herein can also be used in conjunction with the resistor illustrated in FIG. 4, and used with the method by which it can be prepared.

Figure 5:
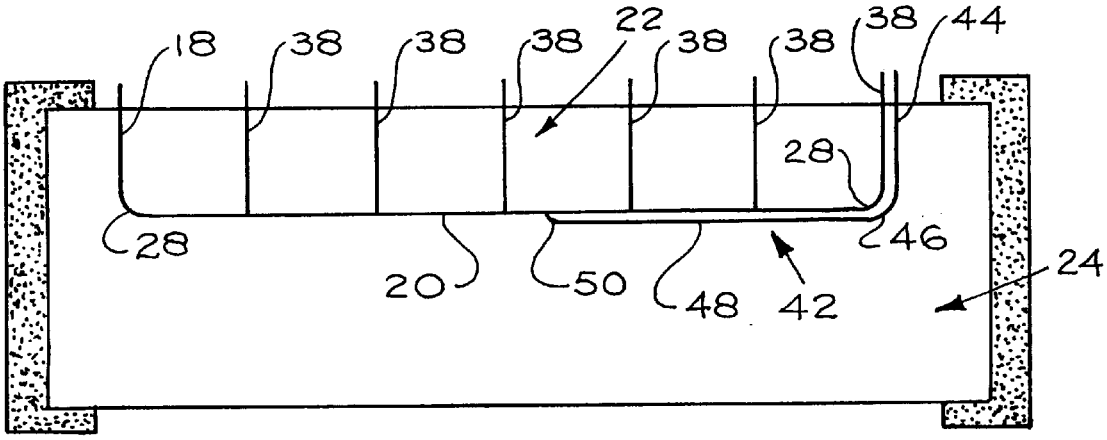
FIGS. 5 and 6 are a schematic representation or electrical resistors illustrating a U-cut coupled with an extended J-cut in accordance with the present invention wherein FIG. 5 further includes a series of plunge-type cuts and FIG. 6 includes an extended J-cut in combination with a J-cut.

Another embodiment of the invention is illustrated in FIG. 5. In this embodiment, an extended J-cut 42 can be used to trim additional material from the resistive portion 24. The extended J-cut 42 is preferably used to trim the value of the resistor component by as much as 3% of the total value of the predetermined final resistance, while other embodiments of J-cuts as described above are generally used to trim the value of the resistor component up to about 1% of the predetermined final resistance value.

Figure 6:
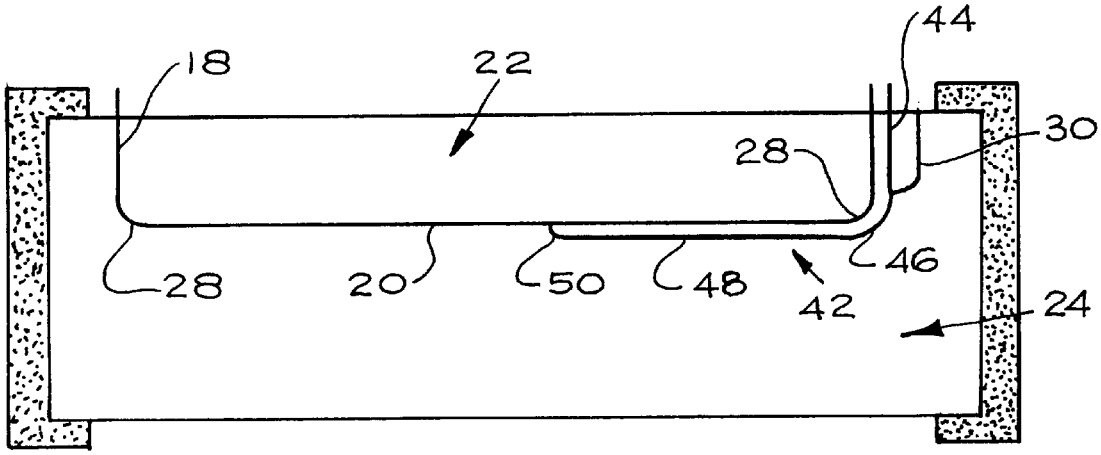

The extended J-cut 42 can comprise an initial cut/groove 44, a curved corner 46, and a curved connector 50. The cut/groove 44 extends into the resistive portion 24 beyond the linear section 20 of the U-cut. The curved connector 50 couples the extended J-cut 42 to the U-cut. Preferably, the extended J-cut 42 further comprises a generally linear section 48 which joins the curved corner 46 to the curved connector 50. In some applications, however, the curved corner 46 and curved connector 50 can form a single curved portion. The length of the initial cut/groove 44 and the length of the generally linear section 48 are both variable to provide various resistance trim levels. As in other embodiments of the invention, one or more plunge cuts 38, extending from the edge of the trimmed portion to the curved portion of the U-cut, may be cut into the trimmed portion 22. Furthermore, as is shown in FIG. 6, the resistor 16 may also be trimmed with both an extended J-cut 42 and a cut/groove 30. The extended J-cuts of this invention can also be used with a variety of initial cuts, including but not limited to that shown in FIG. 4.

In preferred embodiments, the straight cut/groove 44 is preferably substantially parallel to the leg 18 of the U-cut, while the generally linear section 48 is substantially parallel to the linear cut 20 of the U-cut. In these embodiments, therefore, the extended J-cut 42 generally follows the contour of the U-cut. To minimize current crowding, however, the extended J-cut 42 preferably extends only a relatively short distance beyond the linear section 20 of the U-cut into the current pathway. In highly preferred embodiments, the length of the cut/groove 44 is substantially restricted to about two milli-inches beyond the linear section 20 of the U-cut. Also to minimize current crowding, the curved corner 46 and curved connector 50 preferably have a radius or degree of curvature which is substantially equal to that of the curved connector 28. Any of the available laser and monitoring technologies can be used to practice the method and/or apparatus of this invention. To that effect, U.S. Pat. No. 4,929,923 is incorporated by reference herein in its entirety. The technology available under the acronym YAG and recognized by those skilled in the art is especially suitable. In particular, the commercially-available Teradyne W-series and CLS-37 YAG laser systems can be used with results consistent with the scope of this invention. Such a system includes the appropriate software and programming necessary to control various trim parameters. For example, a programming algorithm is incorporated to execute a curved cut. It is also desirable that the velocity of the trim/cut must be held constant because varying laser trim speeds can create heat stress within the resistor. The path of the trim/cut must also be wide enough to minimize voltage stress.

For these reasons, other such programming, operational features are preferably present and used with a component which continuously monitors resistance value during the trim. When used with the present invention, such a laser system can monitor resistance value during execution of the leg portion/groove of a J-cut. Upon reaching a resistance within about 0.5% of the desired value, the system can begin executing a curved cut having a radial dimension predetermined in accordance with a curved portion of an initial U-cut and with consideration of existing current pathways.

As is evident from review of this summary and the figures thereof, the present invention includes a resistor component and/or method of trimming which provides for endpoints out of the current pathway. It is well-known that the last laser pulse forming an endpoint can cause a region of microcracking. Current flow can thereby cause weak spots in the resistor and a drift of resistance value. The present invention alleviates this problem by locating the endpoints of any cut/groove outside the resistive portion or on a previous cut/groove, such that they are necessarily out of the current pathway. Configuration of the grooves/cuts within a resistive portion also incrementally increases resistance value.

EXAMPLES OF THE INVENTION

The following non-limiting examples show various aspects demonstrating the utility of this invention. While such aspects, benefits and advantages are shown with respect to certain embodiments, the same can be obtained via other embodiments of this invention. In particular and in comparison with the prior art, the precise, tight resistance tolerances available are surprising and unexpected.

The data of Examples 1–3 was accumulated using a Teradyne W411 and a CLS-37 YAG laser system and the following parameters: Q rate, 4 KHz; Bite, 0.2 mils, speed, 0.8 in/sec, and laser power of 1.25 watts average power in pulsed mode.

Example 1

A resistor component of the type illustrated in FIG. 3C was tested experimentally under conditions simulating a lightning surge and withstood, without breakdown or resistance drift, a voltage extreme of 2.5 kV.

Example 2

Reduced trim time is available through use of the present invention. For purposes of comparison and using resistors trimmed to a value of about 200 kilo·ohms, a resistance trim of the prior art (U-cut plus a piggy-back scan along the non-leg portion of the U-cut) was done in 172 seconds, while a trim according to this invention (U-cut plus a vernier trim using a J-cut; reference is made to FIG. 2A) was accomplished in 79 seconds: a differential which represents a considerable savings of time and production costs. It would also be observed that the piggy-back scan cut of the prior art, in addition to necessitating additional time, leaves endpoints proximate to existing current pathways.

Example 3

Traditional U-cuts overshoot or undershoot desired resistor values and tolerances because of substrate and/or thick film ink imperfections, either of which can cause non-homogeneous sheet resistivities. As a result, single U-cut post-trim tolerances are typically ±0.5% of the desired value. In contrast, and by way of further demonstrating the utility of the present invention, the traditional U-cut can be used with a J-cut/groove to provide post-trim tolerances of ±0.05%. Such precision is provided without degrading surge power capability and without increasing current crowding.

While the principles of this invention have been described in connection with specific embodiments, it should be understood clearly that these descriptions, along with any data provided, are made only by way of example and are not intended to limit the scope of this invention, in any manner. Other advantages and features of the invention will become apparent from the following claims, with the scope thereof determined by the reasonable equivalents, as understood by those skilled in the art.

I claim:

1. A method of modifying a surge resistor, said method comprising:

providing a thick film high voltage surge resistor with an initial resistance value, said thick film trimmed with a U-cut having endpoints outside said thick film to provide a trimmed film portion on one side of said U-cut and a resistive film portion on the other side of said U-cut; and coupling a J-cut with said U-cut on said resistive film portion, said J-cut having a leg portion along and a distance apart from the leg portion of said U-cut, an endpoint outside said thick film, and a curved connector coupled to a curved corner having a radial dimension like the curved portion of said U-cut, said J-cut increasing the resistance value of the resistor.

2. The method of claim 1 wherein said J-cut leg portion has a variable length dimension.

3. The method of claim 1 further including an additional J-cut joined to at least one of said U-cut and coupled J-cut.

4. The method of claim 1 wherein a generally linear section couples said J-cut to said curved connector.

5. The method of claim 4 wherein said J-cut has a variable length dimension.

6. A method of maintaining a level of current crowding in a trimmed surge resistor while increasing the resistance value of the resistor, said method comprising:

providing a high voltage surge resistor with an initial resistance value, said resistor rimmed with a n initial cut having endpoints outside said resistor to provide a trimmed portion on one side of said cut and a resistive portion on the other side of said cut;

cutting a groove within said resistive portion and along said initial cut, said groove having an initial endpoint outside said resistive portion; and extending said groove to said initial cut with a curved cut extending into the current pathway of the resistor and having a predetermined radial dimension to maintain the level of current crowding.

7. The method of claim 6 wherein said groove has a variable length dimension.

8. The method of claim 6 further including cutting an additional groove and extending said additional groove to said initial cut to further increase the resistance value.

9. The method of claim 6 wherein said initial cut includes at least one plunge cut from the edge of said trimmed portion to said curved portion of said initial cut.

10. The method of claim 6 wherein said initial cut is a U-cut.

11. The method of claim 10 wherein said cut includes a comb cut therewith.

12. A resistor capable of withstanding high power surges, comprising:

a resistive thick film on a substrate between a pair of electrodes;

a U-shaped groove in said thick film dividing said thick film into a resistive portion and a trimmed portion, said U-shaped groove having endpoints outside said thick film and a radius of curvature to control current crowding; and at least one J-shaped groove in said resistive portion and coupled to said U-shaped groove, said J-shaped groove having an endpoint outside said resistive portion, a curved corner, and a curved connector portion, which follow the contour of the U-shaped groove wherein said J-shaped groove increases the resistance value of said resistor.

13. The resistor of claim 12 wherein said U-shaped groove includes at least one plunge cut from the edge of said trimmed portion to said curvature of said U-shaped groove.

14. The resistor of claim 12 further comprising a generally linear section coupling the curved corner to the curved connector portion.

15. The resistor of claim 12 having a plurality of J-shaped grooves, wherein at least one said groove is coupled to said U-shaped groove.

16. The resistor of claim 15 having two J-shaped grooves, wherein each said groove is coupled to said U-shaped groove.

17. The resistor of claim 12 wherein said curved corner and said curved connector portion each has a radius of curvature like the radius of curvature of said U-shaped groove.

18. An electrical resistor component having a precise resistance value and capable of withstanding high power surges, said resistor component of the type in which a thick film is deposited on a substrate and trimmed with a U-cut dividing the thick film into a resistive portion and a trimmed portion, the improvement comprising:

at least one J-cut providing a trim to a desired value, said J-cut having an endpoint outside said resistive portion, a leg portion and a curved portion extending along and apart from the leg portion of said U-cut into the current pathway, and a curved connector portion coupling the J-cut to the U-cut.

19. The resistor component of claim 18 wherein said J-cut leg portion has a variable length dimension.

20. The resistor component of claim 18 wherein said J-cut includes a linear section with a variable length dimension.

* * * * *

UNITED STATES PATENT AND TRADEMARK OFFICE

CERTIFICATE OF CORRECTION

PATENT NO. : 6,107,909
DATED : AUGUST 22, 2000
INVENTOR(S) : JOHN P. KOSINSKI

It is certified that error appears in the above-identified patent and that said Letters Patent is hereby corrected as shown below:

Col. 3, Line 21: "by those" should be inserted after "It will be understood";

Col. 7, Line 5: insert a comma after "is required";

Col. 8, Line 22: insert a paragraph after "connector 28.";

Col. 10, Line 13: delete the space between "a n".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*